US006580801B1

(12) United States Patent
Takagi et al.

(10) Patent No.: US 6,580,801 B1
(45) Date of Patent: Jun. 17, 2003

(54) LOUDSPEAKER APPARATUS

(75) Inventors: Tsuyoshi Takagi, Nishinomiya (JP); Hiroshi Kubota, Nishinomiya (JP); Ken Iwayama, Sanda (JP)

(73) Assignee: TOA Corporation, Kobe (JP)

( * ) Notice: Subject to any disclaimer, the term of this patent is extended or adjusted under 35 U.S.C. 154(b) by 0 days.

(21) Appl. No.: 09/515,949

(22) Filed: Feb. 29, 2000

(30) Foreign Application Priority Data

Mar. 2, 1999 (JP) ..... 11-054623
Mar. 2, 1999 (JP) ..... 11-054666

(51) Int. Cl.[7] ..... H04R 25/00

(52) U.S. Cl. ..... 381/387; 381/87; 381/182; 381/386; 381/395; 181/153

(58) Field of Search ..... 381/87, 303, 304, 381/305, 307, 182, 189, 332, 333, 334, 335, 336, 386, 387, 395, 390, FOR 142, FOR 139, FOR 151; 181/148, 150, 153, 199, 198

(56) References Cited

U.S. PATENT DOCUMENTS 4,210,784 A * 7/1980 Phillips ..... 381/387
4,475,226 A * 10/1984 Greenberg ..... 381/335
4,811,406 A * 3/1989 Kawachi ..... 381/182
4,984,278 A * 1/1991 Frye et al. ..... 381/387
5,574,796 A * 11/1996 Keezer ..... 381/396
5,802,194 A * 9/1998 Yamagishi et al. ..... 381/182
5,859,917 A * 1/1999 Silber et al. ..... 381/386
5,875,255 A * 2/1999 Campbell ..... 381/182
6,101,262 A * 8/2000 Haase et al. ..... 381/387

* cited by examiner

*Primary Examiner*—Curtis Kuntz
*Assistant Examiner*—Suhan Ni
(74) *Attorney, Agent, or Firm*—Duane Morris LLP

(57) ABSTRACT

A loudspeaker apparatus 1 includes a loudspeaker unit 3 and an installation device 2. The loudspeaker unit 3 includes drivers 22 and 23 and an enclosure for the drivers composed of front and rear members 20 and 21. The loudspeaker unit is detachably mounted to an installation device 2, which, in turn, is secured to an installation surface 11 to which the loudspeaker apparatus is to be installed. The loudspeaker unit is mounted rotatable about its center axis 25. The drivers have respective sound radiation center axes 22*a* and 23*a*, which are oriented to intersect the center line 25 at a predetermined angle θ. Thus, the direction in which the drivers radiate sound can be changed by rotating the loudspeaker unit about the center axis.

10 Claims, 5 Drawing Sheets

LOUDSPEAKER APPARATUS

This invention relates to a loudspeaker apparatus and, more particularly, to a watertight loudspeaker apparatus which can be installed on a flat surface, e.g. a wall surface and a ceiling.

BACKGROUND OF THE INVENTION

In general, loudspeaker apparatuses to be installed outdoors are exposed to rain and, therefore, they should be watertight. Conventionally, to make a loudspeaker apparatus watertight, it is enclosed with an airtight enclosure to seal off a vibrating plate of a driver from water, otherwise it would be exposed to external air and water. In order to permit adjustment of the direction in which sound is to be directed, a support device is attached to, for example, a wall of a building, and the loudspeaker apparatus is mounted with its enclosure supported by the support device in such a manner as to permit rotation of the enclosure about a vertical axis. In this case, however, the loudspeaker apparatus protrudes from the wall surface, which, undesirably, may not match the design of the building.

When loudspeaker apparatuses are installed on walls or the like, they may be frequently disposed at an upper location on the wall with the sound radiating aperture of the driver directed downward so that the radiated sound can propagate over a wide range. With the loudspeaker apparatus being tilted downward, sound radiated directly from the loudspeaker apparatus and sound reflected from the wall on which the loudspeaker apparatus is installed interfere with each other to produce peaks and dips of sound at frequencies. Peaks and dips occurring at lower frequencies give more unpleasant effects to auditory sense. Peaks and dips occur at lower frequencies as the distance of the center of the sound radiating aperture from the wall on which the loudspeaker apparatus is installed is larger. Accordingly, as the amount by which the loudspeaker apparatus protrudes from the wall is larger, adverse effects produced by peaks and dips are large, which may give unpleasant effects to auditory sense of audience.

According to another technique to make a loudspeaker apparatus watertight, the loudspeaker apparatus is fixed directly to an installation surface by, for example, screws, and the fixed portions are sealed with a watertight material, e.g. plastics so as to prevent water from penetrating through the fixed portions. With this technique, the amount of protrusion of the loudspeaker apparatus from the installation surface can be smaller, and, accordingly, the above-described peak-and-dip problem may be alleviated, but it is not easy to change the direction of sound emission once the loudspeaker apparatus has been fixed or to remove the loudspeaker apparatus for maintenance.

Therefore, an object of the present invention is to provide a watertight loudspeaker apparatus which can be installed on an installation surface with a relatively small amount of protrusion from the installation surface, can be installed and removed on and from the installation surface with ease, and can easily change the direction in which sound is radiated. Another object of the present invention is to provide a loudspeaker apparatus which can provide reduced effect of peaks and dips.

SUMMARY OF THE INVENTION

According to a first aspect of the present invention, a loudspeaker apparatus includes a disc-shaped installation device having one surface adapted to be fixed to an installation surface on which the loudspeaker apparatus is to be installed. The loudspeaker apparatus further includes a loudspeaker unit having at least one driver and an enclosure. The enclosure of the loudspeaker unit is disposed in such a manner that its rear surface abuts against the front surface of the disc-shaped installation device opposite to the installation surface. The loudspeaker unit radiates a sound wave over a propagation range extending about a sound radiation center axis which intersects, at a predetermined angle, the loudspeaker center axis of the loudspeaker unit extending perpendicularly to the rear surface of the enclosure. The loudspeaker apparatus further includes a coupling unit with which the loudspeaker unit can be mounted to the disc-shaped installation device in such a manner as to be detachable from the installation device and rotatable about the loudspeaker center axis.

The coupling unit may include a flange member formed around the outer periphery of the disc-shaped installation device, and engagement members attached to the outer periphery of the loudspeaker unit at a plurality of locations near the rear surface of the enclosure. The engagement members are detachably engageable with the flange member of the installation device, with the rear surface of the loudspeaker unit abutting against the front surface of the installation device.

A front portion of the installation device and a rear portion of the enclosure may be provided with generally annular portions which abut against each other or are closely spaced from each other. These annular portions are centered about the loudspeaker center axis so that the loudspeaker unit can be rotated about the loudspeaker center axis.

The installation device may be fixed to the installation surface with a first annular seal disposed between the installation device and the installation surface at a location radially inward of the flange member. In this case, the loudspeaker unit is mounted to the installation device with a second annular seal disposed between the loudspeaker unit and the flange member.

A dome-shaped mesh cover may be disposed to cover the front portions of the loudspeaker unit and the installation device.

According to a second aspect of the present invention, a loudspeaker apparatus includes a loudspeaker unit including an enclosure and a plurality of drivers. The loudspeaker unit has a loudspeaker center axis extending perpendicular to the rear surface of the enclosure, which is adapted to be brought into contact with an installation surface, e.g. a building wall, on which the loudspeaker apparatus is to be installed. The drivers are arranged substantially in a line, with their rear portions positioned near one surface of the loudspeaker apparatus, e.g. the rear surface of the enclosure. The drivers radiate respective sound waves over a range about their respective sound radiation center axes, which intersect the loudspeaker center axis of the loudspeaker unit at a predetermined acute angle in a plane which is perpendicular to the rear surface of the enclosure and contains the line along which the drivers are arranged.

The position of each of the drivers with respect to the above-mentioned one surface of the loudspeaker apparatus may be fixed.

The plurality of drivers may be spaced from one another by such a distance that the sound waves radiated from the respective drivers may not be interfered by one another's exteriors.

Where drivers of different sizes are employed, a smaller-sized driver may be arranged on that side of a larger-sized driver toward which the sound wave center axis of the smaller-sized driver is tilted.

The loudspeaker apparatus may be a three-way loudspeaker apparatus which includes a woofer having a larger size, i.e. having a larger sound emerging aperture, a squawker having a smaller size, i.e. a smaller sound emerging aperture, than a woofer, and a tweeter having a size, i.e. a sound emerging aperture, smallest of the three. The squawker is disposed on the side of the woofer toward which the sound wave center axis of the woofer is tilted, and the tweeter is disposed on the side of squawker toward which the sound wave center axis is tilted.

The above-mentioned one surface of the loudspeaker apparatus may be arranged to orthogonally intersect a plane substantially parallel to a vertical plane containing a position where an audience is. The sound radiation axes of the drivers lie in a plane orthogonal to said one surface.

DETAILED DESCRIPTION OF A PREFERRED EMBODIMENT

A loudspeaker apparatus 1 according to an embodiment of the present invention is now descried in detail with reference to the accompanying drawings.

The loudspeaker apparatus 1 includes an installation device 2, a loudspeaker unit 3 and a coupling unit 4.

Figure 2:
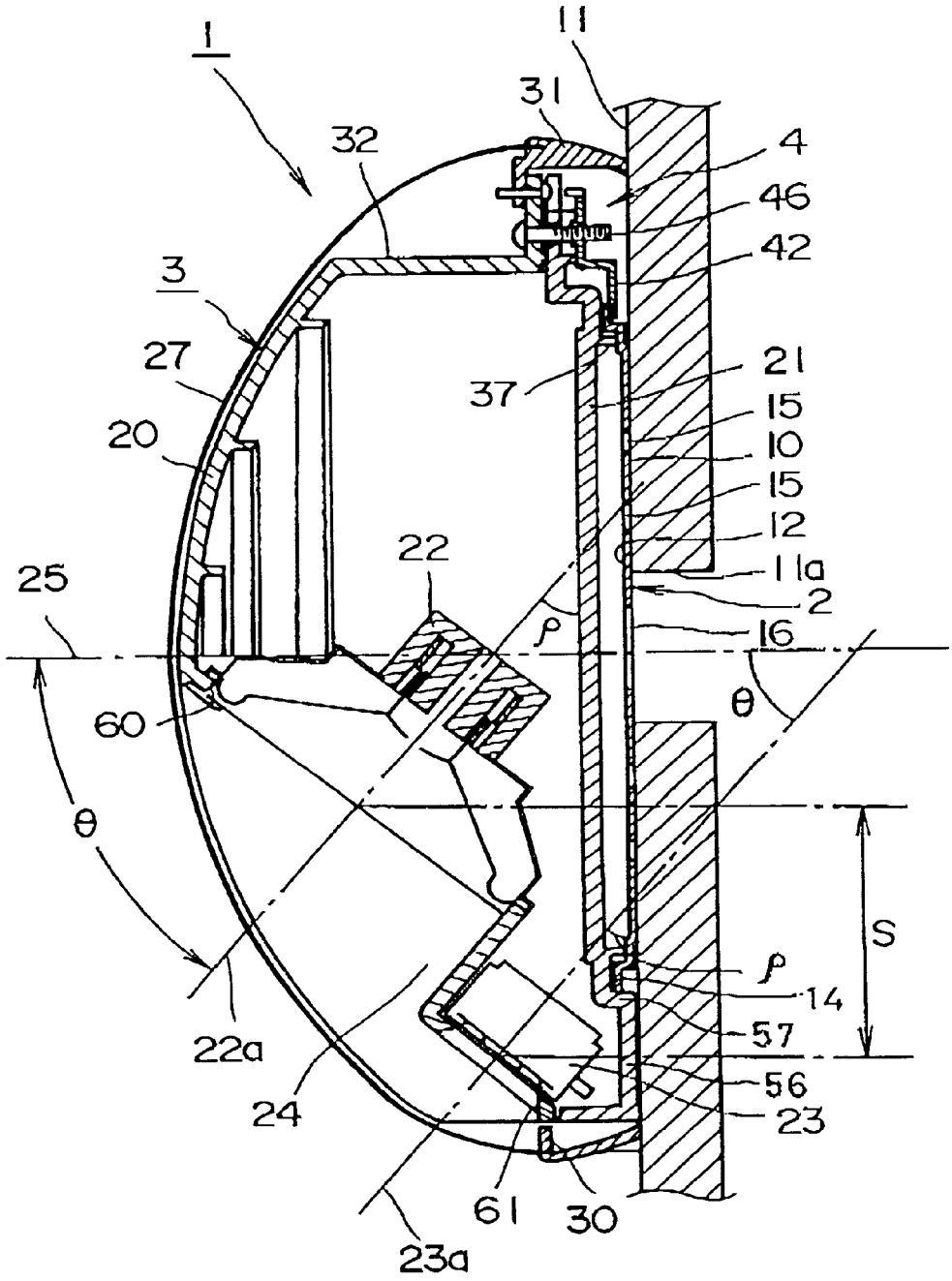
FIG. 2 shows a cross-section of the loudspeaker apparatus along the line II—II in FIG. 1.
Figure 3:
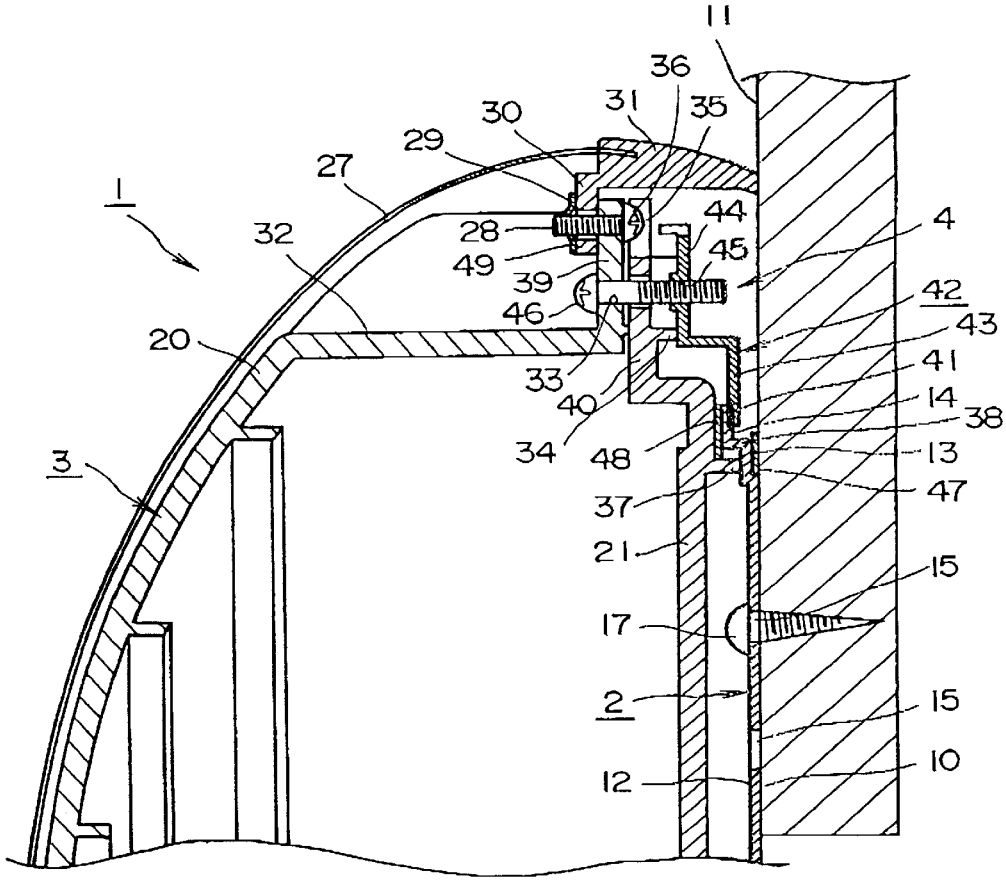
FIG. 3 is an enlarged cross-sectional view of a portion of the loudspeaker apparatus shown in FIG. 2.
Figure 4:
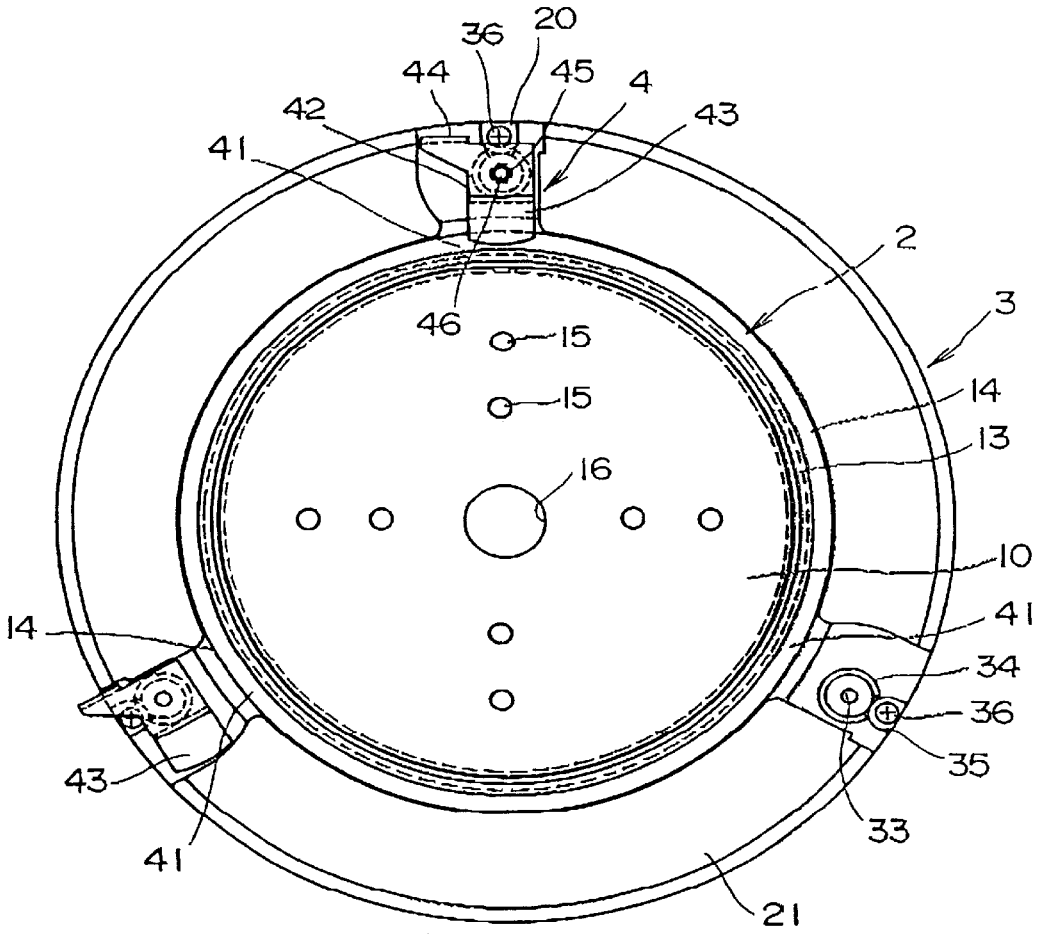
FIG. 4 is a rear view of the loudspeaker apparatus shown in FIG. 1 with the mesh cover removed.

As shown in FIGS. 2 through 4, the installation device 2 is a metal disc formed by pressing a metal plate. The installation device 2 has a front surface 12 on which the loudspeaker unit 2 is mounted and a rear surface 10 which is in contact with an installation surface 11, e.g. a wall of a building, on which the loudspeaker apparatus 1 is installed, as shown in FIGS. 2 and 3. An annular portion 13 and a flange 14 are formed in the outer periphery of the installation device 2. The flange 14 is disposed radially outward of the annular portion 13. The annular portion 13 is stepped away from the rear surface 10 so as to be spaced from the wall 11 by a small distance. The flange 14 is stepped further by an annular riser 38 away from the annular portion 13. The portion of the rear surface 10 radially inward of the annular portion 13 is adapted to contact the wall 11.

A first annular seal 47 is disposed between the annular portion 13 and the wall 11. As shown in FIGS. 2 and 4, a plurality of screw holes 15 for fixing the device 2 with screws and one center hole 16 for passing signal lines therethrough are formed to extend through the portion of the device 2 radially inward of the stepped annular portion 13. Screws 17 are screwed into the wall 11 through some or all of the screw holes 15 to thereby fix the installation device 2 onto the wall 11. When the installation device 2 is fixed to the wall 11 by means of the screws 17, the first seal 47 is pressed against the portion 13 and the wall 11, whereby the portion radially inward of the annular portion 13 is sealed.

Figure 1:
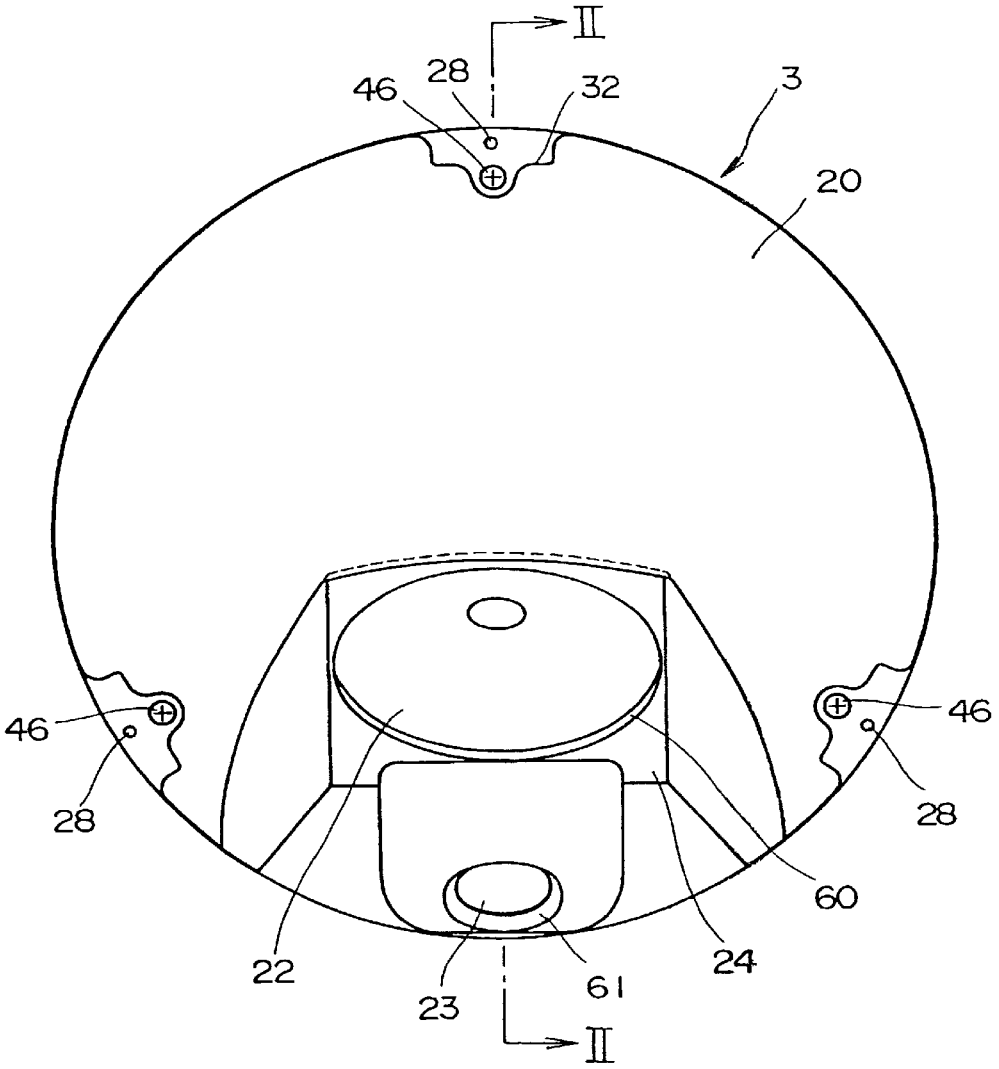
FIG. 1 is a front view of a loudspeaker apparatus installed on an installation surface according to an embodiment of the present invention with a mesh cover removed.

The loudspeaker unit 3 includes an enclosure in which first and second drivers 22 and 23 are enclosed, and which includes a front member 20 and a rear member 21. The front member 20 has a slightly flattened dome shape and has an open rear portion, which is closed by the rear member 21. The front member 20 is provided with a recess 24 in its front surface at a location offset from the center of the dome, as shown in FIG. 1. The recess 24 is provided with two steps. Circular openings 60 and 61 are formed to extend through the respective steps in the recess 24. The opening 60 corresponds in shape to the sound radiating portion or the sound emerging aperture of the driver 22, and the opening 61 corresponds in shape to the sound radiating portion or the sound emerging aperture of the driver 23. The drivers 22 and 23 are secured to the front member 20 in such a manner that they are positioned inside the front member 20 with the respective sound emerging apertures aligned with the openings 60 and 61.

In the illustrated example, the first driver 22 is a cone-type woofer, and the second driver 23 is a balanced dome-type tweeter. The two drivers 22 and 23 are disposed with their respective sound radiation center axes 22*a* and 23*a* similarly oriented. Specifically, as shown in FIG. 2, the drivers 22 and 23, are disposed in such a manner that the sound radiation center axes 22*a* and 23*a* are tilted to form a predetermined same angle θ with respect to a loudspeaker center axis 25 of the driver unit 3 and to intersect the axis 25. The angle θ is, for example, 50°. As stated previously, in this specification, a sound radiation center axis of a driver is defined as such an axis that the sound radiated from the driver propagates over a range about it. The loudspeaker center axis is an axis which is perpendicular to and passes through the center of the rear member 21.

The positional relationship of the drivers 22 and 23 are described later in detail.

The rear member 21 is disc-shaped and has such a size as to close the rear opening of the front member 20 as described above. As shown in FIGS. 2 and 3, an annular ridge 37 extends from the rear or outside surface of the rear member 21. The annular ridge 37 is located in a recess defined by the annular riser 38 of the installation device 2 and has a distal edge abutting against the front surface of the annular portion 13 of the installation device 2. The rear member 21 has an annular seal seat radially outward of the ridge 37, on which a second annular seal 48 is disposed. Thus, the second seal 48 is positioned between the seal seat of the rear member 21 and the inner surface of the flange 14 of the installation device 2.

A generally annular portion 56 (FIG. 2) centered about the loudspeaker center axis 25 is formed in the outer periphery of the rear member 21, except those portions where later-mentioned flange-like portions 40 are provided. The annular portion 56 is formed radially outward of the annular ridge 37 of the rear member 21 and is stepped rearward so that the rear surface of the rear member 21 at the annular portion 56 is located near the wall surface 11. Radially inward of the annular portion 56, an annular riser 57 extends along substantially the entire periphery of the rear member 21, except those portions where the flange-like portions 40 are provided. The flange 14 of the installation device 2 fits into the recess defined by the riser 57 and the ridge 37.

The front member 20 is provided with a flange-like portion 39 in each of three recesses 32 formed in its outer periphery at locations spaced one another by an equal angle, i.e. 120°, as shown in FIG. 1. The corresponding flange-like portion 40 extends outward of the outer periphery of the rear member 21. The flange-like portion 40 is located radially outward of the seal seat. The flange-like portions 39 and 40 are formed to abut against each other. The front member 20 and the rear member 21 may be coupled together by screwing the flange-like portions 39 and 40 together. In the illustrated example, however, the front and rear enclosure members 20 and 21 are joined together by the coupling unit 4, which is used to couple the loudspeaker unit 3 to the installation device 2 as described later.

A mesh cover 27 is disposed in front of the front member 20 with a small spacing disposed between them. The mesh cover 27 is, for example, a plate of, for example, iron, stainless steel or aluminum, in which a large number of small openings are punched through it and which is formed into such a dome shape as to generally conform with the front member 20. The mesh cover 27 is mounted to the front member 20 in the following manner.

In each of the recesses 32 formed in the outer periphery of the front member 20, a projection 28 projecting forward is formed. In the illustrated example, the projection 28 is a screw 36 as shown in FIG. 3. The mesh cover 27 includes an annular base 31 with its distal edge adapted to contact the wall 11. The proximal edge of the base 31 is provided with an integral ring-like member 30 extending inward of it. At the locations on the ring-like member 30 corresponding to the recesses 32 in the front member 20, a flange-like members 49 are integrally formed on the ring-like member 30, as shown in FIG. 3. Through-holes are formed in the flange-like members 49 at the locations corresponding to the respective ones of the three projections 28.

An elastic plate 29, e.g. a leaf spring, is jointed to each of the flange-like members 49. The leaf spring 29 is provided with a circular through-hole with a plurality of slashes formed in the periphery. The leaf spring 29 is carried on the front side of each flange-like member 49 with the circular through-hole located in alignment with the through-hole in the flange-like member 49. By pressing the mesh cover 27 toward the front member 20, the screw 28 goes into the through-hole in the leaf springs 29, whereby the leaf spring 29 elastically fits on the screws 28. In this manner, the mesh cover 27 is held by the front member 20. Because of the elastic engagement between the leaf springs 29 and the screws 28, the mesh cover can be removed from the front member 20 by exerting force to pull the mesh cover 27 away from the front member 20. The mesh cover 27 provides the loudspeaker apparatus 1 with an esthetic appearance and also protects the drivers 22 and 23 from the exterior.

The coupling unit 4 includes three engagement members 42 and associated screws 46. The coupling unit 4 includes also the flange 14 of the installation device 2. Since the arrangements of the three engagement members 42 and the associated screws 46 are the same, only one of the members 42 and its associated screw 46 are described.

The engagement member 42 is formed of a metal plate, which, when viewed from the back side, is generally L-shaped, as shown in FIG. 4. The engagement member 42 includes a vertical leg portion 43, which is adapted to engage with the flange 14, and a horizontal foot portion 44, which is used to cause the leg portion 43 to be engaged and disengaged with and from the flange 14. The leg portion 43 is stepped in such a manner that its distal edge can be positioned to face and be engageable with an engaging surface portion 41 of the flange 14 of the installation device 2 facing toward the wall 11, as shown in FIG. 3. The engagement member 42 is provided with a threaded through-hole 45 therein at the junction between the foot portion 44 and the leg portion 43.

A through-hole 33 is formed in the flange-like portion 39 of the front member 20, and a through-hole is formed in the flange-like portion 40 of the rear member 21 at a location corresponding to the location of the through-hole 33. The locations of these through-holes are such that the screw 46 can extend through these through-holes and the threaded through hole 45 in the engagement member 42. The screw 46 is inserted into the hole 33 and the corresponding through-hole in the flange-like portion 40 and screwed into the threaded through-hole 45.

As shown in FIGS. 3 and 4, a notch 35 is formed in the outer peripheral portion of each of the flange-like portion 40 of the rear member 21 to prevent interference of the flange-like portion 40 with the screw 36.

When the screws 46 are tightened, with all of the engagement members 42 placed in the same position as the topmost engagement member 42 shown in FIG. 4 or in the position as shown in FIGS. 2 and 3, the front member 20, the rear member 21 and the installation device 2 are fastened together. More specifically, when the screw 46 is tightened, the portion around the threaded through-hole 45 of the engagement member 42 is pressed against an annular ridge 34 which is formed integral with the flange-like portion 40 of the rear member 21 and of which a part is removed, as shown in FIG. 3. This causes the rear member 21 and the front member 20 to be pressed against each other. At the same time, the distal edge of the leg portion 43 of the engagement member 42 is pressed against the engaging surface 41 of the flange 14 of the installation device 2. In this manner, the loudspeaker unit 3 is coupled and secured to the installation device 2, which has been secured to the wall 11, by means of the engagement members 42 at the three locations on the periphery.

The annular seals 47 and 48 prevent water or rain from entering into the interior of the loudspeaker unit 3.

The coupling is loosened by loosening the screws 46. With the screws 46 loosened, the engagement members 42 can be rotated about the screws 46 by means of the foot portions 44. When all of the three engagement members 42 are rotated to the positions corresponding to the position of the lower left engagement member 42 shown in FIG. 4, the loudspeaker unit 3 can be removed from the installation device 2.

On the other hand, with the screws 46 loosened and with the engagement members 42 held in engagement with the flange 14, the loudspeaker unit 3 can be rotated about the loudspeaker center axis 25. In this case, the flange 14 of the installation device 2 fits in the recess defined by the riser 57 and the annular ridge 37 on the rear member 21, with the outer peripheral surface of the ridge 14 abutting against the inner surface of the riser 57. Accordingly, the loudspeaker unit 3 can be easily rotated about the loudspeaker center axis 25 because the riser 57 and the ridge 14 can serve as a guide for the rotation.

The loudspeaker apparatus 1 with the above-described arrangement can be installed on the installation surface 11, e.g. an outside wall, an inside wall, a ceiling or, sometimes, a floor of a building. It may be installed on any one of such installation surfaces 11 in the following manner. First, the installation device 2 is fixed to the installation surface 11 by the screws 17, as shown in FIG. 3. Then, the loudspeaker unit 3 is mounted on and secured to the installation device 2 by means of the coupling unit 4. Specifically, the engagement members 42 are rotated by means of the foot portions 44 so as to bring the tip end portions of the leg portions 43 in engagement with the engaging surface portions 41 of the flange 14. After that, the respective screws 46 are tightened. Before tightening the screws 46, the loudspeaker unit 3 is rotated to a position where the sound radiation center axes 22*a* and 23*a* of the respective drivers 22 and 23 are oriented as desired. After that, the mesh cover 27 is mounted on the front member 20 to complete the installation of the loudspeaker apparatus 1.

As described above, the installation of the loudspeaker apparatus 1 according to the present invention is very easy.

If it is not necessary to make the loudspeaker apparatus 1 watertight, the first and second seals 47 and 48 may be omitted.

As described above, the loudspeaker unit 3 can be rotated about the loudspeaker center axis 25 so that the drivers 22 and 23 can be rotated. As the loudspeaker unit 3 rotates, the respective sound radiation center axes 22*a* and 23*a* of the drivers 22 and 23 move to define surfaces of circular cones having their apexes pointed toward the wall 11. Accordingly, the direction in which sound is radiated can be adjusted, and, yet, the loudspeaker apparatus 1 can fit into the surroundings because it has a flat dome shape provided by the mesh cover 27.

The drivers 22 and 23 are arranged in a line with their rear sides opposite to the sound radiating sides positioned near the rear member 21 and, hence, the installation surface 11. Also, the drivers 22 and 23 are tilted to the same side of the loudspeaker center axis 25 with their sound radiation center axes 22*a* and 23a forming the above-mentioned predetermined angle θ with respect to the loudspeaker center axis 25. In other words, the drivers 22 and 23 are arranges in such a manner that their sound radiation center axes 22*a* and 23*a* form an acute angle ρ (=90°−θ) with respect to the installation surface 11 in a plane in which the drivers 22 and 23 are aligned and which is substantially perpendicular to the installation surface 11, and that the sound radiation center axes 22*a* and 23*a* of the drivers 22 and 23 are oriented toward the same direction.

If the loudspeaker apparatus 1 is installed on a vertical wall 11 of a building with the drivers 22 and 23 vertically aligned, the drivers 22 and 23 radiate respective sounds diagonally downward in front of the loudspeaker apparatus 1. The sound radiation center axes 22*a* and 23*a*, when viewed from the front, extend vertically along the same line. Thus, sounds from the respective drivers 22 and 23, i.e. sounds at low and middle frequencies from the woofer 22 and sounds at high and middle frequencies from the tweeter 23, entering into the two ears of a person standing in front of and diagonally beneath the loudspeaker apparatus 1 can be balanced and, therefore, induce pleasant auditory sensation in the audience.

When the drivers 22 and 23 are seen from their lateral sides, as shown in FIG. 2, they radiate sounds in the directions tilted by the angle of ρ with respect to the wall 11 (i.e. at the angle of θ with respect to the loudspeaker center axis 25). If the spacing S between the drivers 22 and 23 were too short, the sound radiated by the driver 22, which is a woofer, would be interfered with by the driver 23, which is a tweeter, or portions of the cabinet associated with the tweeter 23, e.g. portions of the recess 24 in the front member 20. Accordingly, the sound propagation path of the woofer 22 would be blocked.

According to the illustrated embodiment of the present invention, the spacing S between the woofer 22 and the tweeter 23 is large enough to prevent part of the propagation path of the sound from the woofer 22 from being blocked by the tweeter 23 or its associated parts.

Also, according to the illustrated embodiment of the present invention, the sound emerging aperture of the woofer 22, which has larger dimensions than the tweeter 23, is disposed rearward of the sound emerging aperture of the tweeter 23. If the sound emerging aperture of the tweeter 23 were positioned rearward of that of the woofer 22, substantial part of the propagation path of the sound radiated from the tweeter 23 would be blocked by the woofer 22. To avoid it, a large spacing S should be disposed between the woofer 22 and the tweeter 23, which would result in increase in size of the loudspeaker apparatus 1. Therefore, the woofer 22 is disposed rearward of the tweeter 23 as in the illustrated embodiment. In such an arrangement of the woofer 22 and the tweeter 23, the tweeter 23, although positioned forward of the woofer 22, does not interfere with the sound from the woofer 22 much. Accordingly, the spacing S can be small, and, therefore, the loudspeaker apparatus 1 can be small as a whole.

With the drivers 22 and 23 staggered in the direction along the loudspeaker center axis 25 as described above, the wave fronts of the sounds from the two drivers would not be aligned. In order to align the wave fronts at the crossover frequency, an electrical audio signal to be applied to the driver, which is the woofer 22 in the illustrated embodiment, forward of the other, which is the tweeter 23, may be delayed by a time period corresponding to the spacing S.

Although not shown, a through-hole is formed in the rear member 21. Electrical audio signals are supplied to the drivers 22 and 23 through signal conductors (not shown) extending from the respective drivers 22 and 23 through the through-holes in the rear member 21, the center hole 16 in the installation device 2 and a through-hole 11*a* formed in the wall or installation surface 11 to an amplifier or the like (not shown). The signal conductors are connected to the drivers 22 and 23 by means of, for example, connectors, before the loudspeaker unit 3 is mounted to the installation device 2.

In the present invention, too, the sounds directly from the drivers 22 and 23 and the sounds impinging on and reflected from the installation surface 11 interfere with each other to produce peaks and dips in sound. This phenomenon is now discussed with reference to FIGS. 5(*a*) and 5(*b*).

Figure 5A:
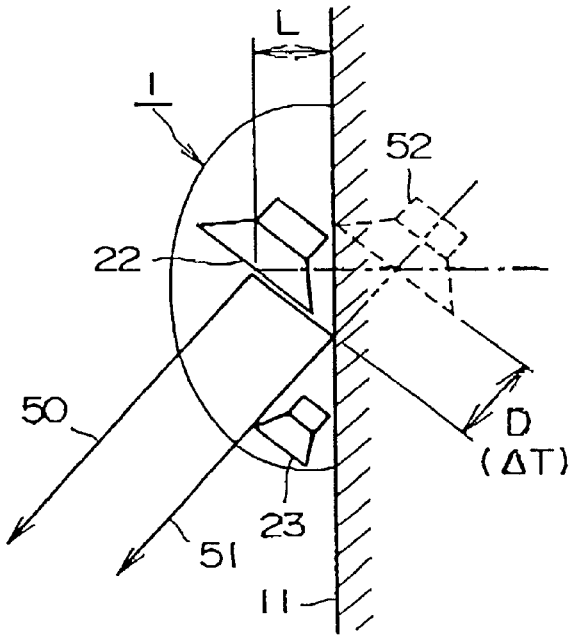
FIGS. 5(*a*) and 5(*b*) show sound propagation of first and second drivers, respectively, of the loudspeaker apparatus shown in FIG. 1.
Figure 5B:
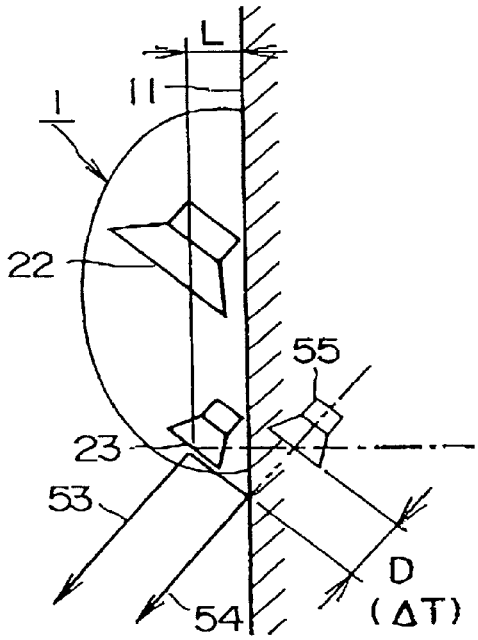

First, the sound from the woofer 22 is considered. As shown in FIG. 5(*a*), sounds emitted into the space include the direct sound represented by an arrow 50 from the woofer 22 and the sound impinging on and reflected from the installation surface 11 represented by an arrow 51. Peaks and dips are produced at a frequency at which a half wavelength (λ/2) is equal to the phase difference ΔT between the direct sound 50 and the reflected sound 51. The peaks and dips produced can be considered as if they were produced by the interference between the direct sound from the woofer 22 and the direct sound from an imaginary woofer 52 represented in a broken line. The imaginary woofer 52 is equivalent to the woofer 22 disposed at the 20 intersection of the extension, represented by a dot-dot-dash-dot-dot line, of the propagation path of the reflected sound 51 with the extension of the perpendicular line, represented by a dot-dash-dot line, from the woofer 22 toward the installation surface 11. In other words, it may be considered as if the reflected sound 51 were radiated by the imaginary driver 52. The distance D in the direction of sound propagation of the sound radiation plane of the real woofer 22 from the radiation plane of the Imaginary woofer 52 corresponds to the phase difference ΔT between the direct sound and the reflected sound.

According to the present invention, the woofer 22 is installed at a location near the installation surface 11. For the woofer 22 of which the diameter of the sound emerging aperture is, for example, about 92 mm, the distance L of the center of the sound emerging aperture of the woofer 22 from the installation surface 11 is 65 mm. This distance L of 65 mm is very short for the woofer 22 of this size. Because of the short distance L, the distance D is also very short, resulting in peaks and dips occurring at relatively high frequencies. At high frequencies, the sound pressure of the sound 51, which has been radiated from the woofer 22, detoured to the installation surface 11 and been reflected from the installation surface 11 is low. Accordingly, the magnitudes of the peaks and dips resulting from the interference of the reflected sound 51 with the direct sound 50 are also small. As the frequencies at which peaks and dips occur are higher, effects given on auditory sensation by peaks and dips, which are unpleasant to audience, are more inappreciable.

As for the tweeter 23, as shown in FIG. 5(*b*), It provides the direct sound represented by an arrow 53 and the reflected sound represented by an arrow 54. The reflected sound 54 is the sound radiated by the tweeter 23, but impinging on and reflected from the installation surface 11. The presence of the direct sound 53 and reflected sound 54 causes peaks and dips in sound. As in the case of the woofer 22 discussed above, it can be considered as if the reflected sound 54 were radiated from an imaginary tweeter 55 disposed at the intersection of the extension, represented by a dot-dot-dash-dot-dot line, of the propagation path of the reflected sound 54 with the perpendicular line, represented by a dot-dash-dot line, drawn from the center of the sound emerging aperture of the tweeter 23 toward the installation surface 11.

In the illustrated embodiment of the present invention, the tweeter 23 is also disposed near the installation surface 11, as the woofer 22. When the diameter of the sound emerging aperture of the tweeter 23 is, for example, about 23 mm, the distance L between the center of the sound emerging aperture and the installation surface 11 is 34 mm. This is a very short distance for this size of the tweeter 23. Because of the short distance L, the distance D can be also very short, which results in occurrence of peaks and dips at higher frequencies. Such peaks and dips at higher frequencies give inappreciable adverse effects on auditory sensation.

As described above, the drivers 22 and 23 are secured to the rear member 21 by means of the front member 20. Accordingly, the loudspeaker unit 3 secured to the rear member 21 can be installed on the installation surface 11, with the line along which the drivers 22 and 23 are arranged oriented in any desired direction and, still, with reduced adverse effects of peaks and dips.

The present invention has been described by means of a two-way loudspeaker apparatus including a woofer and a tweeter. However, the present invention can be embodied in a three-way system, which includes a squawker in addition to a woofer and a tweeter.

Also, the woofer 22 and the tweeter 23 have been stated to be a cone driver and a dome-shaped driver, respectively, but the present invention is not limited to such drivers.

In the illustrated embodiment, the tilt angle $\rho$ of the sound radiation center axes 22*a* and 23*a* relative to the installation surface 11 is 40° (=90°−$\theta$ where $\theta$ is the angle between the loudspeaker center axis 25 and the sound radiation center axes 22*a* and 23*a*, which is equal to 50°). However, the angle $\rho$ and, therefore, the angle $\theta$ are not limited to these values.

What is claimed is:

1. A loudspeaker apparatus comprising:

an enclosure having, in a rear portion thereof, a mounting surface adapted to be secured to an installation surface to which said loudspeaker apparatus is to be installed; and a plurality of drivers being enclosed within said enclosure and having respective sound radiation center axes, said drivers being arranged within said enclosure with rear portions thereof disposed near said mounting surface, said sound radiation center axes lying in a line in one plane perpendicular to said mounting surface and being so oriented in said one perpendicular plane as to be substantially in parallel spaced relation with each other at substantially the same acute angle with respect to said mounting surface.

2. The loudspeaker apparatus according to claim 1 wherein said drivers have their positions relative to said mounting surface fixed.

3. The loudspeaker apparatus according to claim 1 wherein said plurality of drivers are spaced from one another in such a manner that sound radiated by each driver is not blocked by another driver.

4. The loudspeaker apparatus according to claim 3 wherein said plurality of drivers have different dimensions; and a smaller one of said drivers is disposed adjacent in the direction of tilting of said sound radiation center axes to a next larger one of said drivers.

5. The loudspeaker apparatus according to claim 1 wherein said mounting surface is orthogonal to a plane substantially parallel with a vertical plane containing an audience position, and the sound radiation center axes of said drivers are in a plane orthogonal to said mounting surface.

6. A loudspeaker apparatus comprising:

a disc having a first flat rear surface adapted to be secured to an installation surface to which said loudspeaker apparatus is to be installed, and a first flat front surface paralleling said first rear surface;

a flange member extending outward from an outer periphery of said disc, said flange member having a second front surface and a second rear surface paralleling said first front surface and said first rear surface, respectively;

a loudspeaker unit including at least one driver and an enclosure for said driver, said enclosure having a rear member having a third rear surface, said third rear surface being located in front of and substantially in parallel with said disc, an outer periphery of said rear member being located radially outward of an outer periphery of said flange member, said driver having a sound radiation center axis intersecting, at a location in front of said rear member, a loudspeaker center axis perpendicular to said rear member at a predetermined angle; and a plurality of engagement members spaced about said loudspeaker center axis, said engagement members being in contact with said third rear surface of said rear member and said second rear surface of said flange member; and a plurality of pressing means extending from the front of said loudspeaker unit through said rear member and respective ones of said engagement members to thereby urge said engagement members against said flange member.

7. The loudspeaker apparatus according to claim 6 wherein concentric annuli about said loudspeaker center axis are formed in said first front surface of said disc and said third rear surface of said enclosure, one of said concentric annuli projecting from said first front surface toward said third rear surface, the other of said concentric annuli projecting from said third rear surface toward said first front surface.

8. The loudspeaker apparatus according to claim 6 wherein a first annular seal is disposed between an outer peripheral portion of said first rear surface of said disc and said installation surface, and a second annular seal is disposed between said second front surface of said flange member and said third rear surface of said rear member.

9. The loudspeaker apparatus according to claim 6 further comprising a dome-shaped mesh cover disposed to cover front portions of said loudspeaker unit and disc.

10. The loudspeaker apparatus according to claim 6 wherein said loudspeaker unit includes a plurality of drivers arranged in a line within said enclosure with rear portions thereof located near said rear member of said enclosure, the sound radiation center axes of said drivers lying in a plane containing said loudspeaker center axis of said loudspeaker unit and perpendicular to said installation surface said sound radiation center axes being similarly oriented in said plane.

* * * * *